United States Patent [19]

Fendley et al.

[11] Patent Number: 4,894,037

[45] Date of Patent: Jan. 16, 1990

[54] FACTORY FIXTURE FRAME WITH MEANS FOR TEMPORARILY AND REMOVABLY SUPPORTING AN IN-PROCESS TENSION MASK FOR A COLOR CATHODE RAY TUBE

[75] Inventors: James R. Fendley, Arlington Hts.; John M. Jarosz, Skokie, both of Ill.

[73] Assignee: Zenith Electronics Corporation, Glenview, Ill.

[21] Appl. No.: 139,892

[22] Filed: Dec. 31, 1987

[51] Int. Cl.[4] ..... H01J 9/227

[52] U.S. Cl. ..... 445/30; 24/462; 160/371; 38/102.91; 445/37

[58] Field of Search ..... 140/109, 108; 38/102.91; 160/371, 378; 24/462; 29/451; 445/30, 37, 68

[56] References Cited

U.S. PATENT DOCUMENTS

| | | | |
|---|---|---|---|
| 2,104,473 | 1/1938 | Watson | 24/462 X |
| 2,548,163 | 4/1951 | Kaufmann | 160/371 |
| 2,625,734 | 1/1953 | Law | 445/52 |
| 2,654,940 | 10/1953 | Law | 29/447 |
| 2,837,153 | 6/1958 | Brown et al. | 160/371 |
| 3,553,862 | 1/1971 | Hamu | 140/108 X |
| 3,894,321 | 7/1975 | Moore | 313/402 |
| 3,962,805 | 6/1976 | Hamu | 160/371 X |
| 4,341,007 | 7/1982 | Kruszona | 29/451 |
| 4,547,696 | 10/1985 | Strauss | 313/407 |
| 4,591,344 | 5/1986 | Palac | 445/30 |
| 4,593,224 | 6/1986 | Palac | 313/407 |
| 4,656,389 | 4/1987 | Palac | 445/68 X |
| 4,790,786 | 12/1988 | Stauss | 445/68 |

OTHER PUBLICATIONS

Improvements in the RCA Three-Beam Shadow Mask Color Kinescope, by Grimes et al., The IRE, Jan. 1954; decimal classification R583.6.

*Primary Examiner*—Kenneth J. Ramsey

[57] ABSTRACT

A reusable factory fixture frame is disclosed for use in the manufacture of a color cathode ray tube having a flat faceplate and a tensed foil shadow mask. The frame provides for mounting an in-process shadow mask during photoexposure of an in-process faceplate in a lighthouse. The frame includes a generally rectangular frame structure having grooves thereabout for receiving an edge of the shadow mask. At least one elongatge rod-like member extending lengthwise of and complementarily mating with the grooves temporarily and removably support an in-process shadow mask in tension. The shadow mask is heated and allowed to expand prior to being temporarily and removably supported on the frame, and the shadow mask is allowed to cool and shrink in tension while so being supported to effect tensing of the shadow mask in clamped condition on the frame.

11 Claims, 3 Drawing Sheets

FACTORY FIXTURE FRAME WITH MEANS FOR TEMPORARILY AND REMOVABLY SUPPORTING AN IN-PROCESS TENSION MASK FOR A COLOR CATHODE RAY TUBE

CROSS-REFERENCE TO RELATED APPLICATIONS AND PATENTS

This application is related to but in no way dependent upon copending applications Ser. Nos. 583,003, filed September 30, 1983; 646,861, filed August 31, 1984; 758,174, filed July 23, 1985; 831,696, filed February 21, 1986; 894,984, filed October 22, 1986; 947,727, filed December 30, 1986; 051,896, filed May 18, 1987; 131,968, filed December 10, 1987; 058,095, filed June 4, 1987; 140,019, filed December 31, 1987; 139,997, filed December 31, 1987; and U.S. Pat. Nos. 3,894,321; 4,069,567; 4,547,696; 4,591,344; 4,593,224; and 4,595,857, all of common ownership herewith.

BACKGROUND OF THE INVENTION

1. Field Of The Invention

This invention relates to color cathode ray picture tubes, and is addressed specifically to improved factory means and processes for the manufacture of a tube having a tensed foil shadow mask. Color tubes of various types that have a tension foil mask can be manufactured by the process, including those used in home entertainment television receivers. The invention is particularly valuable in the manufacture of medium-resolution, high-resolution, and ultra-high resolution tubes intended for color monitors.

The use of a foil-type flat tensed mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements on the faceplate. The tensed mask when heated distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tensed foil shadow mask is a part of the cathode ray tube front assembly, and is located in close adjacency to the faceplate. The front assembly comprises the faceplate with its screen which consists of deposits of light-emitting phosphors, a shadow mask, and support means for the mask. As used herein, the term "shadow mask" means an apertured metallic foil which may, by way of example, be about 0.001 inch or less in thickness. The mask must be supported under high tension a predetermined distance from the inner surface of the cathode ray tube faceplate. This distance is known as the "Q-distance". As is well known in the art, the shadow mask acts as a color-selection electrode, or parallax barrier, which ensures that each of the three electron beams lands only on its assigned phosphor deposits.

The conventional process of depositing patterns of color phosphor elements on the screening surface of a color picture tube faceplate utilizes the well-known photoscreening process. A shadow mask, which in effect functions as a perforated optical stencil, is used in conjunction with a light source to expose in successive steps, three discrete light-sensitive photoresist patterns on the screening surface. The shadow mask is typically "mated" to each faceplate; that is, the same mask is used in the production of a specific tube throughout the production process, and is permanently installed in the tube in final assembly. At least four engagements and four disengagements of the mask, as well as six exposures, are required in the standard screening process. In certain processes, a "Master" may be used for exposing the photoresist patterns in lieu of the mated shadow mask.

2. Prior Art

There have been a number of disclosures of tensed foil masks and means for applying tension to the mask and retaining the mask under tension. Typical of these is the disclosure of Law in U.S. Pat. No. 3,625,734 which addresses the construction of a taut, planar foraminous mask. A foil mask blank is loosely mounted in a two-section frame, and the mask is expanded by the hot-blocking process. Machine screws peripheral to the frame provide for clamping the mask tightly in the frame when the mask is in its expanded state. The mask becomes tensed upon cooling as it is restrained from returning to its former dimensions by its captivation by the frame. The frame with the mask enclosed is mounted with the phosphor-screen as a unitary assembly adjacent to the inner surface of the faceplate. Law in U.S. Pat. No. 2,654,940 also discloses means for stretching and captivating by frames masks formed from wire mesh.

U.S. Pat. No. 3,894,321 to Moore, of common ownership herewith, is directed to a method for processing a color cathode ray tube faceplate in conjunction with a thin foil tension shadow mask. A frame screw-clamp supports a tensed mask during lighthouse exposure of an associated screen. The faceplate is registered with the mask support frame by means of three alignment posts which extend from the lighthouse, and against which the frame and the faceplate are both biased by gravity. The faceplate and frame, being both referenced to the three lighthouse posts, are thereby referenced to each other.

U.S. Pat. No. 4,591,344 to Palac, of common ownership herewith, discloses a method of making a color cathode ray tube in which a frame on which a shadow mask is stretched has indexing means cooperable with registration-affording means on a faceplate. The assembly provides for multiple registered matings of the faceplate and mask during photoscreening operations. A photographic plate is used in a process for applying the phosphor elements to the faceplate screening surface to provide an interchangeable mask system. This in lieu of the more common method of using a shadow mask permanently mated with a faceplate, and which serves as an optical stencil during the photoscreening process. The sealing areas of the faceplate and the frame are joined in a final assembly operation such that the frame becomes an integral constituent of the cathode ray tube.

A mask registration and supporting system for a cathode ray tube having a rounded faceplate with a skirt for attachment to a funnel is disclosed by Strauss in U.S. Pat. No. 4,547,696 of common ownership herewith. The skirt of the faceplate provides the necessary Q-distance between the mask and the screen. A frame dimensioned to enclose the screen comprises first and second spaced-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. Following final assembly, the frame is permanently fixed in place within the tube envelope between the sealing lands of the faceplate and a funnel, with a stiffening member projecting from the frame into the funnel.

In U.S. Pat. No. 4,593,224 to Palac, of common owership herewith, there is disclosed a shadow mask mount in the shape of a rectangular frame for use in tensing an in-process shadow mask, and for temporarily supporting the mask while in tension. An apertured foil comprising the in-process mask is laid across the opening in the frame and is secured to the frame by brazing or welding. The coefficient of thermal expansion of the foil is preferably equal to or slightly less than that of the frame. A glass frame is also provided that consists of two identical rectangular members smaller in circumferential dimension than the metal frame. When joined into a single frame, the members are located between the tube faceplate and funnel to become an integral part of the tube envelope in final assembly. Each member of the glass frame has indexing means, one member for indent-detent registration with the faceplate, and the other for indent-detent registration with the funnel. Following the application of a layer of devitrifying cement in paste form to the facing surfaces of the two members, the mask, held in the metal frame, is sandwiched between the two members. As the assembly is heated, the expansion of the mask is taken up by screw means attached to the metal frame which press against the peripheries of the members. Upon cooling of the assembly, the coefficient of thermal expansion of the mask, being greater than that of the glass, results in the mask being held permanently in tension by the glass frame through the medium of the frit cement, which has become solidified by the heat. The portion of the mask that projects beyond the periphery of the glass frame is severed to release the metal frame. The glass frame with its captivated mask is then mounted on a lighthouse for photoscreening the faceplate, with registration with the lighthouse and faceplate provided by the indent-detent means described.

In referent copending application Ser. No. 831,696 of common ownership herewith, there is disclosed an apparatus for tensing a foil shadow mask. The apparatus comprises a pedestal having registration-affording means, and a tensing structure which includes a fixture comprising a pair of collars for clamping the edge of a foil to support and maintain the foil in a taut condition. An anvil is provided for engaging a peripheral portion of the clamped foil to induce deflection of the foil, and thereby, a predetermined tension in the foil. Following a photoscreening process, the mask is secured to shadow mask supports extending from the faceplate by welding.

In a journal article, there is described means for mounting a flat tensed mask on a frame for use in a color cathode ray tube having a circular faceplate with a curved viewing surface. In one embodiment, the mask, which is also circular, is described as being welded to a circular frame comprised of a ⅛-inch steel section. The frame with captivated mask is mounted in spaced relationship to a phosphordot plate, and the combination is assembled into the tube as a package located adjacent to the faceplate. ("Improvements in the RCA Three-Beam Shadow Mask Color Kinescope," by Grimes et al. The IRE, January 1954; decimal classification R583.6.).

OBJECTS OF THE INVENTION

It is a general object of this invention to provide means to facilitate the manufacture of color cathode ray tubes having a tensed foil shadow mask.

It is an object of this invention to provide improved fixturing means that will facilitate the manufacture of color cathode ray tubes having a tensed foil shadow mask.

It is another object of this invention to provide improved fixturing means for use in manufacturing an in-process assembly comprising a tensed foil in-process shadow mask and a faceplate.

It is a further object of this invention to provide a factory fixture frame including tensed foil in-process shadow mask clamping means for quickly and securely clamping and retaining a shadow mask under high tension without damage to the mask.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DETAILED DESCRIPTION OF THE PREFERRED EMBODIMENT

To facilitate understanding of the factory fixture frame and its relation to the process of manufacturing a tensed mask cathode ray tube, copending application Ser. No. 051,896, filed May 18, 1987, is incorporated herein by reference. That application sets forth in detail the components of a factory fixture frame for an in-process tension mask color cathode ray tube and its relationship to the tube components.

Briefly, the factory fixture frame according to the invention of the aforementioned copending application provides for high precision in the registration and reregistration of a foil in-process shadow mask with a flat face plate during manufacture. The factory fixture frame is reusable and provides for the cementless and weldless quick-retention of an in-process shadow mask during fabrication of the associated color cathode ray tube. As described in detail therein, the factory fixture frame has first six-point indexing means on a first side for registration with complementary registration-affording means on an exposure lighthouse during manufacture of a color cathode ray tube. A second six-point indexing means is provided on a second, opposed side of the factory fixture frame for registration with complementary registration-affording means on an in-process faceplate. Therefore, the in-process shadow mask can be precisely registered and reregistered with the lighthouse and the in-process faceplate for the photoexposure of the faceplate while retaining the shadow mask in tension. The present invention is directed to a quick-release mechanical mask-retaining means for use on the reusable factory fixture frame to temporarily and removably support the in-process shadow mask in tension.

Figure 1:
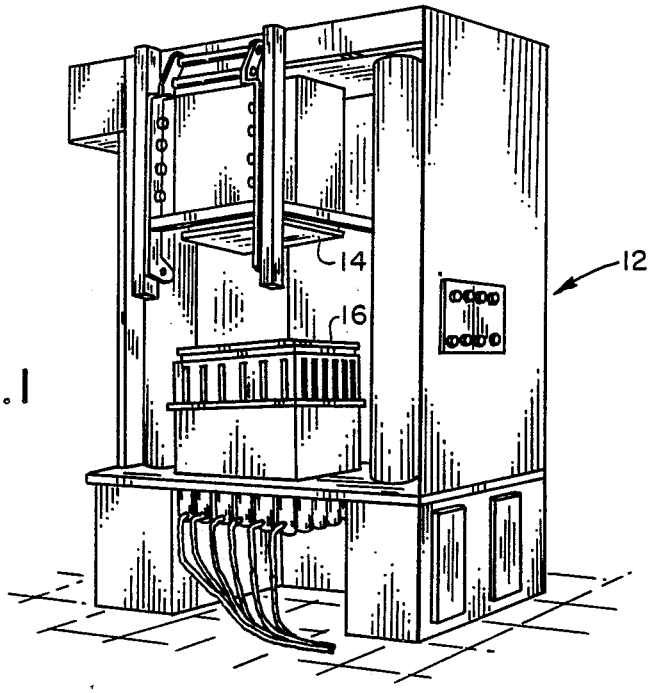
FIG. 1 is a view in elevation and in perspective of a mask tensing-clamping machine for receiving a factory fixture frame and mask retaining means according to the invention.

Referring generally to the drawings, FIG. 1 shows a mask tensing-clamping machine, generally designated 12, which provides for receiving the factory fixture frame which is loaded into the mask tensing-clamping machine by an operator. The machine has an upper platen 14 and a lower platen 16 which are heated to provide for expansion of the shadow mask blank prior to the clamping operation.

Figure 2:
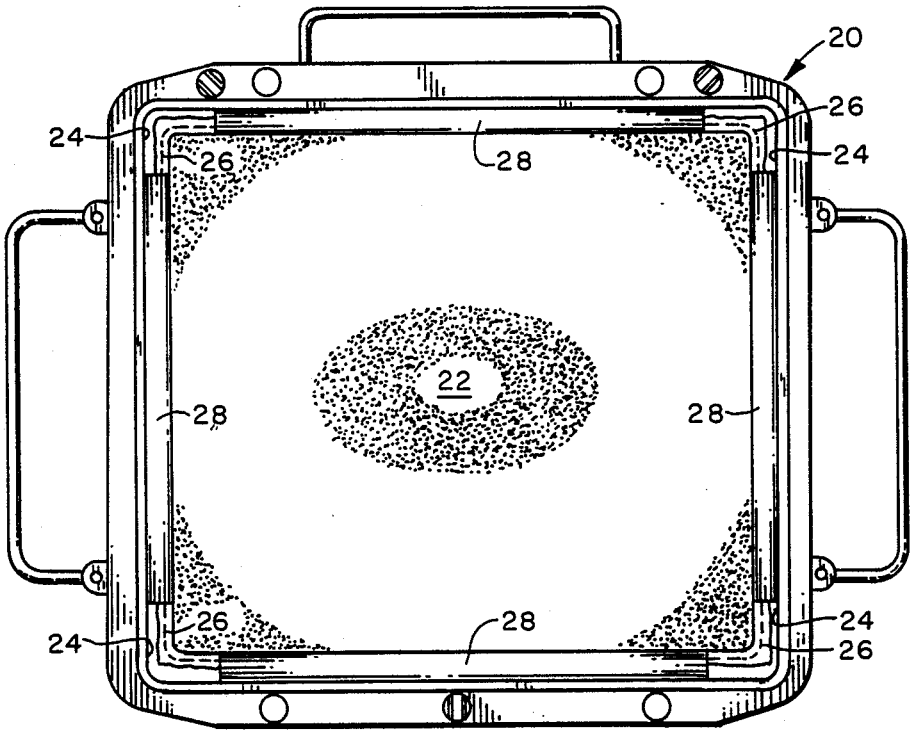
FIG. 2 is a plan view of a factory fixture frame according to the invention with peripheral groove means within which an in-process shadow mask is temporarily and removably supported in tension.

FIG. 2 shows a factory fixture frame, generally designated 20, for the high precision in registering and reregistering a foil in-process shadow mask with a faceplate during manufacture. More particularly (and as described in application Ser. No. 051,896), factory fixture frame 20 provides for mounting an in-process shadow mask 22 during photoexposure of an in-process faceplate in a lighthouse, and serves as a fixture for the process of welding and trimming the in-process mask. The factory fixture frame is reusable and comprises a generally rectangular frame means and quick-release mechanism mask-retaining means (described hereinafter) for temporarily and removably supporting an in-process shadow mask 22 in tension. frame 20 is shown as supporting shadow mask 22 in tension. The factory fixture frame provides for the cementless and weldless quick-retention of in-process shadow mask 22 out of the plane of the mask. Without going into great detail, suffice it to say that factory fixture frame 20 includes receptacle means in the form of grooves 24 (FIG. 10) for receiving an edge 26 of shadow mask 22 and within which the mask edge is clamped.

Mask tensing-clamping machine 12 (FIG. 1) receives factory fixture frame 20 which is loaded into the machine by an operator. The machine also provides for receiving shadow mask 22 in a free state between upper and lower platens 14 and 16, respectively. Generally, the platens are heated to provide for expansion of shadow mask 22 as the platens sandwich the mask therebetween. Edges 26 of the shadow mask are clamped into grooves 24 while the shadow mask is heated. The shadow mask then is allowed to cool and shrink in tension while being temporarily and removably supported on frame 20. The frame, with its tensed shadow mask, then is ready to be transported through other processing steps, such as the aforesaid photoexposure of an in-process faceplate in a lighthouse.

Figure 3:
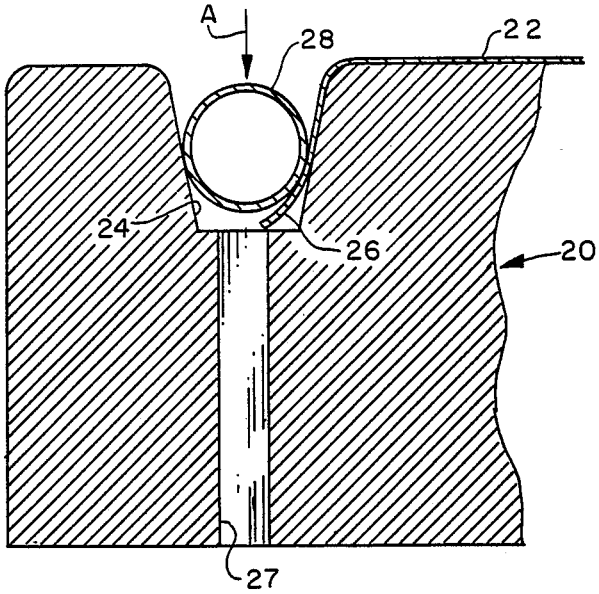
FIG. 3 is a fragmented section through a portion of the factory fixture frame illustrating the peripheral groove means with one form of mask retaining means according to the invention.

Referring to FIG. 3, a peripheral portion of factory fixture frame 20 is shown with a peripheral groove 24. Shadow mask 22 is illustrated with an edge portion 26 thereof being clamped within a "keystone", or angled sidewall, groove 24 by elongated mechanical mask-retaining means in the form of a tube-like member 28. The tube-member is generally cylindrical and is forced into groove 24 in the direction of arrow "A" to wrap the edge of the shadow mask around the edge of the groove. In essence, the tube-like member is of metal or other hard material and is afforded a press-fit retention within groove 24 by virtue of the self-locking angle feature of the groove, thereby sandwiching the edge of the shadow mask between the tube-like member and the sides of the groove. This provides a temporary and removable support of an in-process shadow mask in tension.

A series of access holes 27 (only one shown) are arranged to communicate between the bottom of groove 24 and the outside of frame 20 to permit insertion of a comb-like tool in order to extricate tube 28.

In operation and in conjunction with machine 10, upper and lower platens 14 and 16 are actuated to sandwich shadow mask 22 therebetween. The platens then are heated to heat the shadow mask and allow the mask to expand. While the shadow mask is still heated, the shadow mask is brought into position generally coplanar with the top of factory fixture frame 20, as seen in FIG. 3. While still heated, rod-like member 28 is forced into groove 24 wrapping the edge 26 of shadow mask 22 around the corners of the groove therewith to temporarily and removably support the shadow mask in the groove. The heated platens then are separated and the shadow mask is allowed to cool and shrink in tension while still being temporarily and removably supported on frame 20 by virtue of tube-like member 28 being seated in groove 24.

Figure 4:
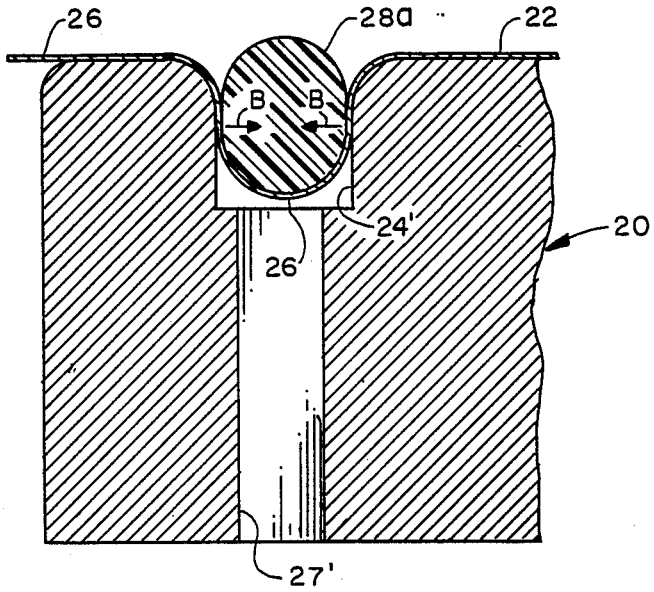
FIG. 4 is a view similar to that of FIG. 3 illustrating another form of the mask retaining means.

FIG. 4 shows a form of the invention somewhat similar to that of FIG. 3, but the tube-like member **28*a* is fabricated of compressible material, such as nylon or like material. This enhances the wrapping and gripping of edge 26 of shadow mask 22 between the side walls of groove 24'. For this embodiment, the walls of groove 24' are not angled or keystoned. It can be seen in FIG. 4 that compressible tube-like member 28*a* has been compressed generally in the direction of arrows "B". Otherwise, the operation is the same as that described in relation to the form of the invention shown in FIG. 3 in regard to the sequence of heating the shadow mask and allowing it to cool shrink. The FIG. 4 embodiment is also provided with a series of access holes 27' (only one shown) to facilitate removal of tube 28*a***.

Figure 5:
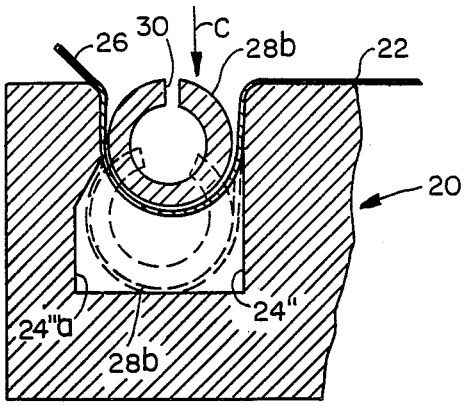
FIG. 5 is a view somewhat similar to that of FIGS. 3 and 4, illustrating a further form of the mask retaining means; and FIGS. *6a–6f* are views somewhat similar to FIGS. 3–5, illustrating the sequence of operation of still another form of the mask retaining means.

FIG. 5 shows another form of the invention wherein the tube-like member is identified as **28*b* and is split, as at 30, lengthwise of the tube to provide compressibility of the tube. This not only enhances the wrapping and clamping capability of the tube similar to that of the compressible tube 28*a* of FIG. 4**, but as will be shown, this embodiment of the invention also includes means to facilitate ready removal of the tube.

More particularly, in the embodiment of the invention shown in FIG. 5, groove 24'' is undercut or enlarged at the base thereof, as at **24''*a*, such that the base of the groove is wider than the uncompressed diametral dimension of the tube. After the shadow mask is cooled and allowed to shrink, tube 28*b* is forced downwardly in the direction of arrow "C" to the position shown in phantom where it is uncompressed and thus substantially loose within undercut portion 24**″*a* of groove 24″. The tube then can be removed simply by sliding the tube lengthwise out of the groove either before or after the edge portion of the shadow mask has been severed.

FIGS. 6*a*–6*f* show another form of the invention which embodies a pair of rod-like members 28*c* and 28*d*. It also should be noted that the bottom of the groove 24‴ how has a stepped configuration defining a "high" ledge portion 24‴*b* and a lower base portion 24‴*c*. Rod 28*c* is of relatively hard material, such as metal, and rod 28*d* is of relatively soft compressible material, such as nylon. It additionally should be noted that rod 28*c* is of a larger diameter than that of rod 28*d*.

Figure 6A:
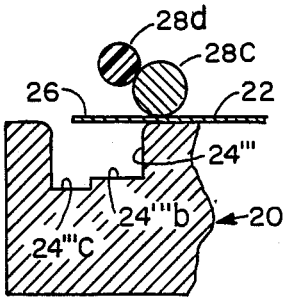
Figure 6B:
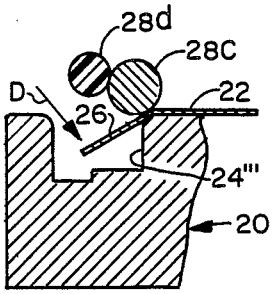
Figure 6C:
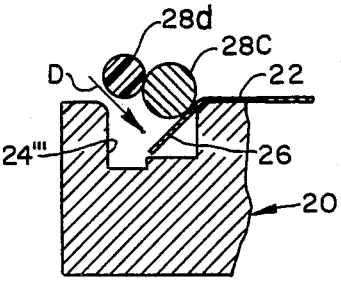
Figure 6D:
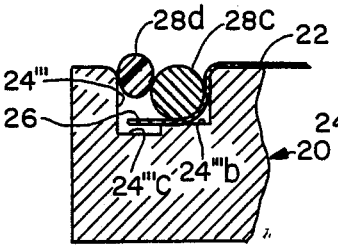
Figure 6E:
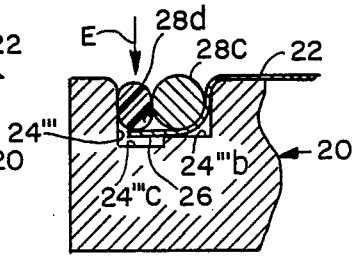
Figure 6F:
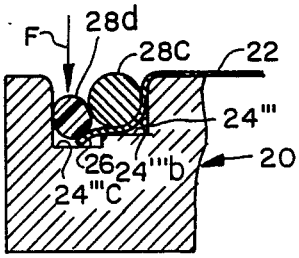

In operating the embodiment of the invention shown in FIGS. 6*a*–6*f*, edge 26 of shadow mask 22 is brought into the position shown in FIG. 6*a*, with the mask in heated condition and with rods 28*c*, 28*d* then being brought to overlay the mask. FIGS. 6*b* and 6*c* show rods 28*c*, 28*d* brought into position to wrap mask edge 26 around the upper rounded corner of groove 24‴, in the direction of arrows "D". FIG. 6*d* shows the wrapping of the mask edge completed, with enlarged rod 28*c* now seated on top of ledge 24‴*b*. Smaller rod 28*d* is brought further into the groove in the direction of arrow "E" as shown in FIG. 6*e*, so that both rods are now in a tight press-fit within the groove to temporarily and removably support the in-process shadow mask in tension. After the shadow mask is allowed to cool and shrink in tension, rods 28*c*, 28*d* are readily removed by forcing smaller rod 28*d* further into the groove, in the direction of arrow "F" (FIG. 6*f*) beyond or "overcenter" larger rod 28*c*. This release feature is afforded by the stepped configuration of the bottom of groove 24‴, and the release action is similar to that disclosed in regard to the undercut groove portion 24″*a* described in connection with the embodiment of the invention shown in FIG. 5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. For use in the manufacture of a color cathode ray tube having a flat faceplate and a tensed foil shadow mask, a factory fixture frame for mounting an in-process shadow mask, the frame including peripheral groove means for receiving an edge of the shadow mask, and an elongate, generally cylindrical rod-like member which is split lengthwise thereof to provide compressibility and to press-fit into said groove means for temporarily and removably supporting an in-process shadow mask in tension.

2. The factory fixture frame of claim 1 wherein at least one side of said groove means is undercut to allow the rod-like member to be pressed into the undercut area of the groove means to quickly release the edge of the shadow mask.

3. For use in the manufacture of a color cathode ray tube having a flat faceplate and a tensed foil shadow mask, a factory fixture frame for mounting an in-process shadow mask, the frame including peripheral groove means for receiving an edge of the shadow mask, a rod-like member extending length-wise of and complementarily mating with said groove means for temporarily and removably supporting an in-process shadow mask in tension, the rod-like member being split lengthwise thereof to provide compressibility of the rod-like member for press-fitting into said groove means and to enhance gripping the edge of the shadow mask.

4. For use in the manufacture of a color cathode ray tube having a flat faceplate and a tensed foil shadow mask, a factory fixture frame for mounting an in-process shadow mask, the frame including peripheral groove means for receiving an edge of the shadow mask, elongate quick-release mechanical mask-retaining means extending lengthwise of and and complementarily mating with said groove means for temporarily and removably supporting an in-process shadow mask in tension, said elongate mask retaining means comprising a pair of rod-like members, one of said rod-like members being located for engaging the edge of the shadow mask along an inner edge of the groove means and the other of the rod-like members being located outside the one rod-like member to hold the one member in mask-supporting position, said rod-like members being generally cylindrical and said one rod-like member being of a greater diameter than the other rod-like member.

5. For use in the manufacture of a color cathode ray tube having a flat faceplate and a tensed foil shadow mask, a factory fixture frame for mounting an in-process shadow mask, the frame including peripheral groove means for receiving an edge of the shadow mask, elongate quick-release mechanical mask-retaining means extending length-wise of and complementarily mating with said groove means for temporarily and removably supporting an in-process shadow mask in tension, said elongate mask retaining means comprising a pair of rod-like members, one of said rod-like members being located for engaging the edge of the shadow mask along an inner edge of the groove means and the other of the rod-like members being located outside the one rod-like member to hold the one member in mask-supporting position, and wherein said groove means, at least in the area beneath the other rod-like member, is enlarged to allow the other rod-like member to be moved overcenter the one rod-like member to quickly release the edge of the shadow mask.

6. For use in the manufacture of a color cathode ray tube having a flat faceplate and a tensed foil shadow mask, a factory fixture frame for mounting an in-process shadow mask, the frame including peripheral groove means for receiving an edge of the shadow mask, elongate quick-release mechanical mask-retaining means extending length-wise of and complementarily mating with said groove means for temporarily and removably supporting an in-process shadow mask in tension, said elongate mask retaining means comprising a pair of rod-like members, one of said rod-like members being located for engaging the edge of the shadow mask along an inner edge of the groove means and the other of the rod-like members being located outside the one rod-like member to hold the one member in mask-supporting position, wherein said groove means, at least in the area beneath the other rod-like member, is enlarged to allow the other rod-like member to be moved overcenter the one rod-like member to quickly release the edge of the shadow mask, and including stop means to hold the one rod-like member while the other rod-like member is being moved.

7. For use in the manufacture of a color cathode ray tube having a flat faceplate and a tensed foil shadow mask, a factory fixture frame for mounting an in-process shadow mask, the frame including peripheral groove means for receiving an edge of the shadow mask, elongate quick-release mechanical mask-retaining means extending length-wise of and complementarily mating with said groove means for temporarily and removably supporting and in-process shadow mask in tension, said elongate mask retaining means comprising a pair of rod-like members, one of said rod-like members being located for engaging the edge of the shadow mask along an inner edge of the groove means and the other of the rod-like members being located outside the one rod-like member to hold the one member in mask-supporting position, wherein said groove means, at least in the area beneath the other rod-like member, is enlarged to allow the other rod-like member to be moved overcenter the one rod-like member to quickly release the edge of the shadow mask, and including stop means in the form of shoulder means formed in said groove means to hold the one rod-like member while the other rod-like member is being moved.

8. For use in the manufacture of a color cathode ray tube having a flat faceplate and a tensed foil shadow mask, a factory fixture frame for mounting an in-process shadow mask, the frame including peripheral groove means for receiving an edge of the shadow mask, and a pair of elongate rod-like members extending lengthwise of said groove means, one of said rod-like members being located for engaging the edge of the shadow-mask along an inner edge of the groove means and the other of the rod-like members being located outside the one rod-like member to hold the one member in mask-supporting position for temporarily and removably supporting an in-process shadow mask in tension, and wherein said rod-like members are generally cylindrical and said one rod-like member is of a greater diameter than the other rod-like member.

9. For use in the manufacture of a color cathode ray tube having a flat faceplate and a tensed foil shadow mask, a factory fixture frame for mounting an in-process shadow mask, the frame including peripheral groove means for receiving an edge of the shadow mask, and a pair of elongate rod-like members extending lengthwise of said groove means, one of said rod-like members being located for engaging the edge of the shadow-mask along an inner edge of the groove means and the other of the rod-like members being located outside the one rod-like member to hold the one member in mask-supporting position for temporarily and removably supporting an in-process shadow mask in tension, and wherein said groove means, at least in the area beneath the other rod-like member, is enlarged to allow the other rod-like member to be moved overcenter the one rod-like member to quickly release the edge of the shadow mask.

10. For use in the manufacture of a color cathode ray tube having a flat faceplate and a tensed foil shadow mask, a factory fixture frame for mounting an in-process shadow mask, the frame including peripheral groove means for receiving an edge of the shadow mask, and a pair of elongate rod-like members extending lengthwise of said groove means, one of said rod-like members being located for engaging the edge of the shadow-mask along an inner edge of the groove means and the other of the rod-like members being located outside the one rod-like member to hold the one member in mask-supporting position for temporarily and removably supporting an in-process shadow mask in tension, said groove means, at least in the area beneath the other rod-like member, being enlarged to allow the other rod-like member to be moved overcenter the one rod-like member to quickly release the edge of the shadow mask, and including stop means to hold the one rod-like member while the other rod-like member is being moved.

11. For use in the manufacture of a color cathode ray tube having a flat faceplate and a tensed foil shadow mask, a factory fixture frame for mounting an in-process shadow mask, the frame including peripheral groove means for receiving an edge of the shadow mask, and a pair of elongate rod-like members extending lengthwise of said groove means, one of said rod-like members being located for engaging the edge of the shadow-mask along an inner edge of the groove means and the other of the rod-like members being located outside the one rod-like member to hold the one member in mask-supporting position for temporarily and removably supporting an in-process shadow mask in tension, said groove means, at least in the area beneath the other rod-like member, being enlarged to allow the other rod-like member to be moved overcenter the one rod-like member to quickly release the edge of the shadow mask, and including stop means in the form of shoulder means formed in said groove means to hold the one rod-like member while the other rod-like member is being moved.

* * * * *